US006017131A

United States Patent [19]

Goins

[11] Patent Number: 6,017,131

[45] Date of Patent: Jan. 25, 2000

[54] ILLUMINATED MAIL BOX POST

[76] Inventor: Marilyn D. Goins, 7527 Florence Dr., Hixson, Tenn. 37343

[21] Appl. No.: 09/174,353

[22] Filed: Oct. 15, 1998

[51] Int. Cl.[7] ..... F21V 21/00

[52] U.S. Cl. ..... 362/249; 362/431; 362/251

[58] Field of Search ..... 362/249, 251–253, 362/236, 431, 457; 40/541, 552, 553

[56] References Cited

U.S. PATENT DOCUMENTS

| | | | |
|---|---|---|---|
| D. 327,857 | 7/1992 | Vaughan | D10/109 |
| 4,003,040 | 1/1977 | Browand | 340/332 |
| 4,547,761 | 10/1985 | Jones | 340/331 |
| 4,587,753 | 5/1986 | Harper | 40/451 |
| 4,611,265 | 9/1986 | Davis | 362/145 |
| 4,901,461 | 2/1990 | Edwards et al. | 40/575 |
| 4,984,142 | 1/1991 | Garnerone | 362/249 |

*Primary Examiner*—James Phan

[57] ABSTRACT

A new illuminated mail box post for illuminating the address displayed on the post and to indicate to an emergency location to emergency response personnel. The inventive device includes an elongate main post having an interior space, a top end and a ground engaging bottom end. An elongate arm is coupled to the main post which is designed for attaching a mail box thereto. A wall is provided in the interior space of the main post to divide the interior space into upper and lower compartments. A first light source is provided in the lower compartment of the interior space of the main post. The main post has a number of lower windows providing openings into the lower compartment of the interior space of the main post. A second light source which provides light of a unique color is provided in the upper compartment of the interior space of the main post. The main post has a number of upper windows which provide openings into the upper compartment of the interior space of the main post.

11 Claims, 2 Drawing Sheets

ILLUMINATED MAIL BOX POST

BACKGROUND OF THE INVENTION

1. Field of the Invention

The present invention relates to illuminated mail box posts and more particularly pertains to a new illuminated mail box post for illuminating the address displayed on the post and to indicate to an emergency location to emergency response personnel.

2. Description of the Prior Art

The use of illuminated mail box posts is known in the prior art. More specifically, illuminated mail box posts heretofore devised and utilized are known to consist basically of familiar, expected and obvious structural configurations, notwithstanding the myriad of designs encompassed by the crowded prior art which have been developed for the fulfillment of countless objectives and requirements.

Known prior art illuminated mail box posts include U.S. Pat. No. 4,611,265; U.S. Pat. No. 4,901,461; U.S. Pat. No. Des. 327,857; U.S. Pat. No. 4,587,753; U.S. Pat. No. 4,547,761; and U.S. Pat. No. 4,003,040.

While these devices fulfill their respective, particular objectives and requirements, the aforementioned patents do not disclose a new illuminated mail box post. The inventive device includes an elongate main post having an interior space, a top end and a ground engaging bottom end. An elongate arm is coupled to the main post which is designed for attaching a mail box thereto. A wall is provided in the interior space of the main post to divide the interior space into upper and lower compartments. A first light source is provided in the lower compartment of the interior space of the main post. The main post has a number of lower windows providing openings into the lower compartment of the interior space of the main post. A second light source which provides light of a unique color is provided in the upper compartment of the interior space of the main post. The main post has a number of upper windows which provide openings into the upper compartment of the interior space of the main post.

In these respects, the illuminated mail box post according to the present invention substantially departs from the conventional concepts and designs of the prior art, and in so doing provides an apparatus primarily developed for the purpose of illuminating the address displayed on the post and to indicate to an emergency location to emergency response personnel.

SUMMARY OF THE INVENTION

In view of the foregoing disadvantages inherent in the known types of illuminated mail box posts now present in the prior art, the present invention provides a new illuminated mail box post construction wherein the same can be utilized for illuminating the address displayed on the post and to indicate to an emergency location to emergency response personnel.

The general purpose of the present invention, which will be described subsequently in greater detail, is to provide a new illuminated mail box post apparatus and method which has many of the advantages of the illuminated mail box posts mentioned heretofore and many novel features that result in a new illuminated mail box post which is not anticipated, rendered obvious, suggested, or even implied by any of the prior art illuminated mail box posts, either alone or in any combination thereof.

To attain this, the present invention generally comprises an elongate main post having an interior space, a top end and a ground engaging bottom end. An elongate arm is coupled to the main post which is designed for attaching a mail box thereto. A wall is provided in the interior space of the main post to divide the interior space into upper and lower compartments. A first light source is provided in the lower compartment of the interior space of the main post. The main post has a number of lower windows providing openings into the lower compartment of the interior space of the main post. A second light source which provides light of a unique color is provided in the upper compartment of the interior space of the main post. The main post has a number of upper windows which provide openings into the upper compartment of the interior space of the main post.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated mail box post apparatus and method which has many of the advantages of the illuminated mail box posts mentioned heretofore and many novel features that result in a new illuminated mail box post which is not anticipated, rendered obvious, suggested, or even implied by any of the prior art illuminated mail box posts, either alone or in any combination thereof.

It is another object of the present invention to provide a new illuminated mail box post which may be easily and efficiently manufactured and marketed.

It is a further object of the present invention to provide a new illuminated mail box post which is of a durable and reliable construction.

An even further object of the present invention is to provide a new illuminated mail box post which is susceptible of a low cost of manufacture with regard to both materials and labor, and which accordingly is then susceptible of low prices of sale to the consuming public, thereby making such illuminated mail box post economically available to the buying public.

Still yet another object of the present invention is to provide a new illuminated mail box post which provides in the apparatuses and methods of the prior art some of the advantages thereof, while simultaneously overcoming some of the disadvantages normally associated therewith.

Still another object of the present invention is to provide a new illuminated mail box post for illuminating the address displayed on the post and to indicate to an emergency location to emergency response personnel.

Yet another object of the present invention is to provide a new illuminated mail box post which includes an elongate main post having an interior space, a top end and a ground engaging bottom end. An elongate arm is coupled to the main post which is designed for attaching a mail box thereto. A wall is provided in the interior space of the main post to divide the interior space into upper and lower compartments. A first light source is provided in the lower compartment of the interior space of the main post. The main post has a number of lower windows providing openings into the lower compartment of the interior space of the main post. A second light source which provides light of a unique color is provided in the upper compartment of the interior space of the main post. The main post has a number of upper windows which provide openings into the upper compartment of the interior space of the main post.

Still yet another object of the present invention is to provide a new illuminated mail box post that illuminates the numbers of the dwelling displayed on the post for easy viewing in the dark.

Even still another object of the present invention is to provide a new illuminated mail box post that has a light source providing light of a unique color, such as red, to indicate an emergency at the dwelling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
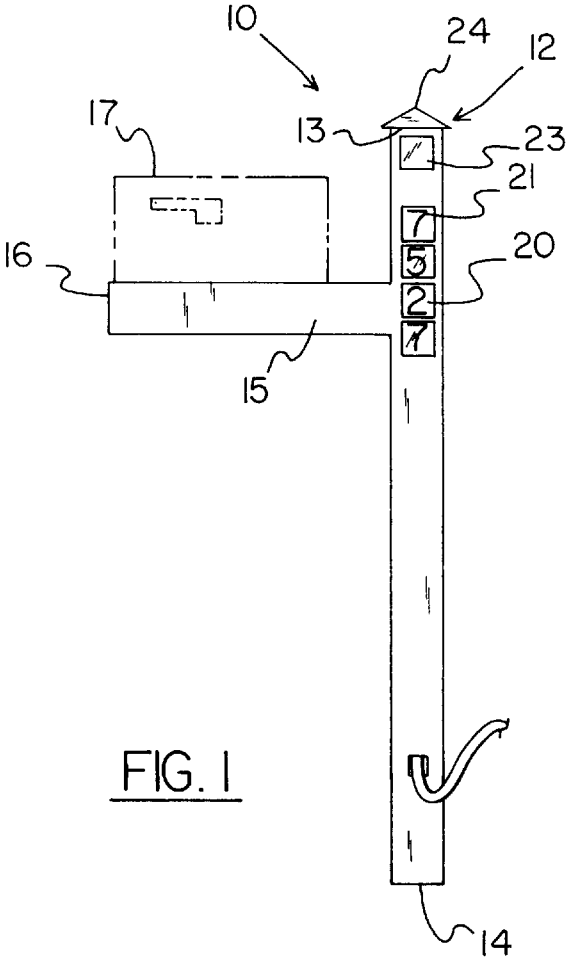
FIG. 1 is a schematic side view of a new illuminated mail box post according to the present invention.

With reference now to the drawings, and in particular to FIGS. 1 through 6 thereof, a new illuminated mail box post embodying the principles and concepts of the present invention and generally designated by the reference numeral 10 will be described.

As best illustrated in FIGS. 1 through 6, the illuminated mail box post 10 generally comprises an elongate main post 12 having an interior space, a top end 13 and a ground engaging bottom end 14. An elongate arm 15 is coupled to the main post 12 which is designed for attaching a mail box 17 thereto. A wall 18 is provided in the interior space of the main post 12 to divide the interior space into upper and lower compartments. A first light source 19 is provided in the lower compartment of the interior space of the main post 12. The main post 12 has a number of lower windows 19 providing openings into the lower compartment of the interior space of the main post 12. A second light source 22 which provides light of a unique color is provided in the upper compartment of the interior space of the main post 12. The main post 12 has a number of upper windows 23 which provide openings into the upper compartment of the interior space of the main post 12.

Specifically, the elongate main post 12 has an interior space, a top end 13, a ground engaging bottom end 14. As illustrated in the Figures, preferably the main post 12 has a generally rectangular cross section and has four elongate sides extending between the ends of the main post 12. Optionally, the main post 12 may be generally cylindrical in shape. The length of the main post extends between the top and bottom ends 13,14 of the main post 12. Preferably, the length of the main post 12 is greater than about 3 feet. In an ideal illustrative embodiment the length of the main post 12 is about 7 feet. In this ideal embodiment, the main post 12 preferably has a width defined between one pair of opposite sides of the main post 12 greater than about 6 inches and a depth defined between another pair of opposite sides of the main post 12 preferably greater than about 4 inches.

Figure 5:
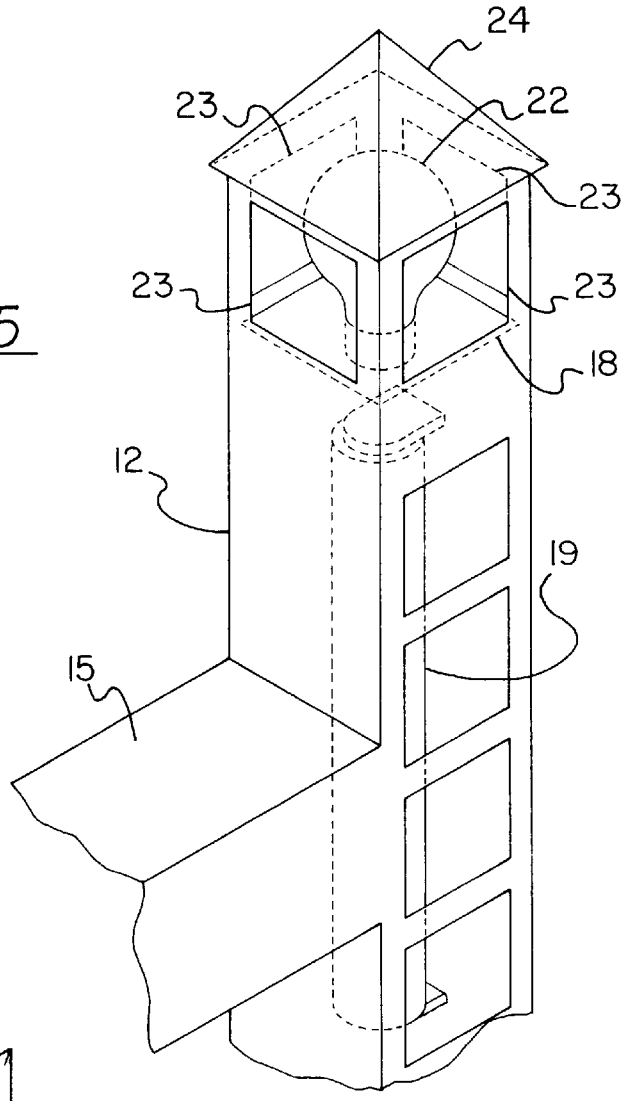
FIG. 5 is a schematic perspective view of the top end of the present invention.
Figure 6:
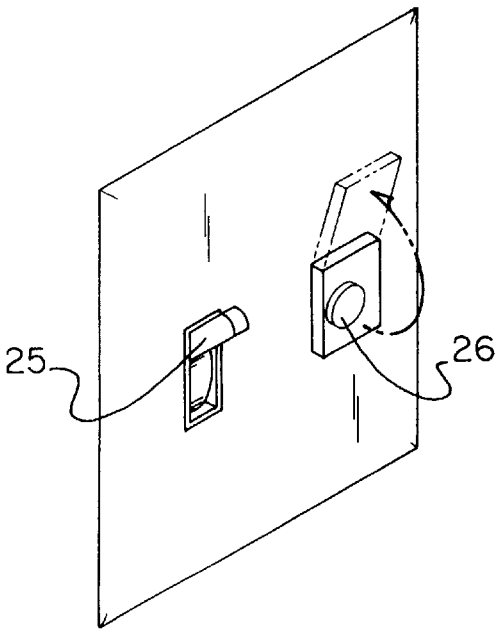
FIG. 6 is a schematic perspective view of the remote actuators of the present invention.

An elongate arm 15 coupled to one of the sides of the main post 12. The arm 15 is for coupling a mail box 17 thereto. The arm 15 is positioned towards the top end 13 of the main post 12. The arm 15 has a free end 16 and a length which extends substantially perpendicular to the length of the main post 12. In the ideal illustrative embodiment, the length of the arm 15 is about 17 inches. Optionally, the free end 16 of the arm 15 may be cut at about a 45 degree angle with respect to the length of the arm 15.;

With reference to FIG. 5, a wall 18 is provided in the interior space of the main post 12. The wall 18 divides the interior space of the main post 12 into upper and lower compartments. The wall 18 is preferably located between the top end 13 of the main post 12 and the arm 15. A first light source 19 is provided in the lower compartment of the interior space of the main post 12. A second light source 22 is provided in the upper compartment of the interior space of the main post 12. Preferably, the first light source 19 comprises a fluorescent light bulb. The second light source 22 provides light of a unique color. Preferably, the unique color of the second light source 22 is red. Ideally, the second light source 22 is a red colored light bulb. In use, the wall 18 is designed for blocking the shining of light from the first light source 19 into the upper compartment and for preventing light from the second light source 22 from entering the lower compartment of the interior space of the main post 12.

Figure 2:
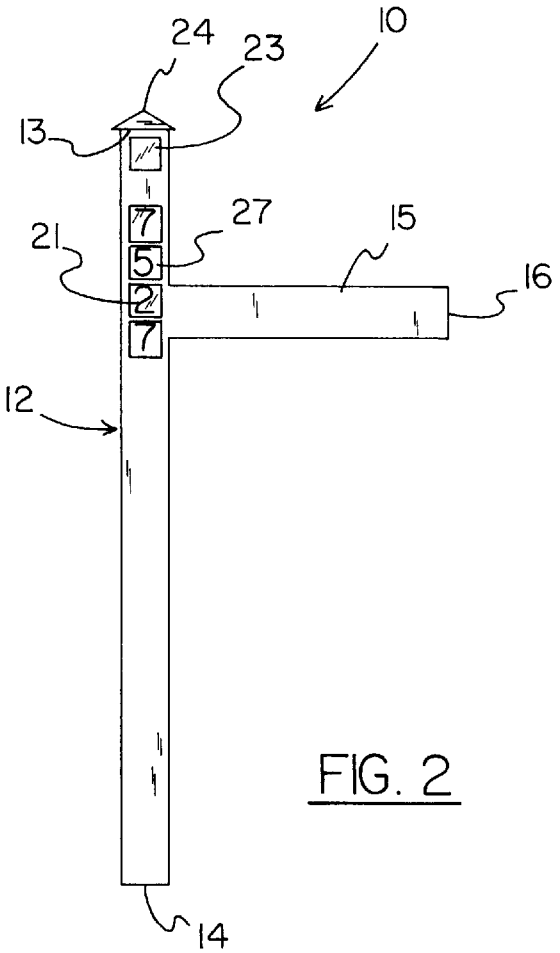
FIG. 2 is another schematic side view of the present invention.
Figure 3:
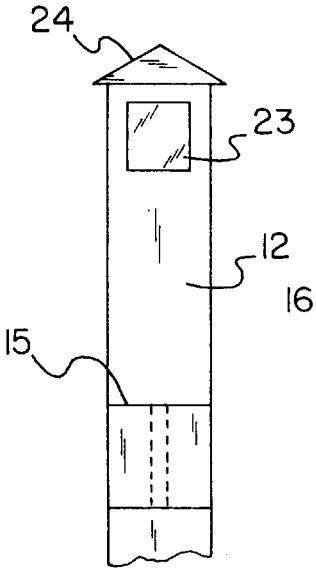
FIG. 3 is a schematic partial side view of the top end of the present invention.
Figure 4:
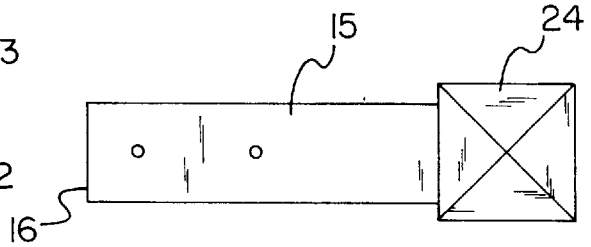
FIG. 4 is a schematic top end view of the present invention.

Another side of the main post 12 has a number of generally transparent lower windows 19. The lower windows 19 provide openings into the lower compartment of the interior space of the main post 12 to permit light from the first light source 19 to shine therethrough. The lower windows 19 are preferably generally rectangular and ideally have a width greater than about 2 inches. The lower windows 19 are spaced apart from each other and arranged in a row extending between the top and bottom ends 13,14 of the main post 12. Each of the lower windows 19 has generally opaque indicia 21 thereon such that light shining through the window outlines the indicia 21 on the lower windows 19. The indicia 21 denote the address of the dwelling of the post. Optionally as illustrated in FIG. 2, another set of lower windows 27 into the lower compartment may be provided on a third side of the main post opposite the other side having lower windows 20

The main post 12 also has a number of generally transparent upper windows 23 providing openings into the upper compartment of the interior space of the main post 12. The upper windows 23 permit passage of light therethrough from the second light source 22 in the upper compartment. The upper windows 23 are generally rectangular and has a width greater than about 4 inches on the sides defining the depth of the main post 12 therebetween and a width greater than about 2 inches on the sides defining the width of the main post 12 therebetween. The upper windows 23 are preferably arranged in a row extending around the main post 12 in a plane substantially perpendicular to the length of the main post 12 with each of the sides of the main post 12 having one of upper windows 23 located thereon.

Ideally, the top end 13 of the main post 12 has a top opening into the upper compartment of the interior space. The top opening permits access to the interior space of the main post 12 to allow changing of the light sources. In this ideal embodiment, a top cap 24 is provided to cover the top opening. Preferably, the top cap is generally pyramidal in shape.

First and second remote actuators 25,26 are also provided. The first remote actuator 25 is connected to the first light source 19 and the second remote actuator 26 is connected to the second light source 22. In use, the first and second remote actuators 25,26 permit selective activation of their associated light source. In use, a user would activate the first remote actuator to illuminate the lower windows so that the indicia on the lower windows may be ascertained by a viewer in the dark. When the user desires notifying a viewer, such as an emergency response person, that an emergency is occurring in the dwelling, the user may activate the second light source with the second remote actuator.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated mail box post, comprising:

an elongate main post having an interior space, a top end, a ground engaging bottom end, and a length extending between said top and bottom ends of said main post;

an elongate arm coupled to said main post, said arm being for coupling a mail box thereto;

a wall being provided in said interior space of said main post, said wall dividing said interior space of said main post into upper and lower compartments;

a first light source being provided in said lower compartment of said interior space of said main post;

said main post having a number of lower windows providing openings into said lower compartment of said interior space of said main post;

a second light source being provided in said upper compartment of said interior space of said main post, said second light source providing light of a unique color;

said main post having a number of upper windows providing openings into said upper compartment of said interior space of said main post; and first and second remote actuators, said first remote actuator being connected to said first light source, said second remote actuator being connected to said second light source, said first and second remote actuators permitting selective activation of the associated light source.

2. The illuminated mail box post of claim 1, wherein said main post has a generally rectangular cross section and has four elongate sides extending between said ends of said main post, wherein an elongate arm is coupled to one of said sides of said main post, wherein said lower window are located on another side of said main post, and wherein each of said sides of said main post has one of upper windows located thereon.

3. The illuminated mail box post of claim 2, wherein said upper windows are arranged in a row extending around said main post in a plane substantially perpendicular to said length of said main post.

4. The illuminated mail box post of claim 1, wherein said main post is generally cylindrical.

5. The illuminated mail box post of claim 1, wherein the length of said arm is extended substantially perpendicular to said length of said main post.

6. The illuminated mail box post of claim 1, wherein said wall is located between said top end of said main post and said arm.

7. The illuminated mail box post of claim 1, wherein said first light source comprises a fluorescent light bulb, and wherein said unique color of said second light source is red.

8. The illuminated mail box of claim 1, wherein said lower windows are arranged in a row extending between said top and bottom ends of said main post.

9. The illuminated mail box post of claim 1, wherein each of said lower windows has generally opaque indicia thereon.

10. The illuminated mail box post of claim 1, wherein said top end of said main post having a top opening into said upper compartment of said interior space, and wherein a top cap covers said top opening of said main post.

11. An illuminated mail box post, comprising:

an elongate main post having an interior space, a top end, a ground engaging bottom end, and a length extending between said top and bottom ends of said main post;

wherein said main post has a generally rectangular cross section and has four elongate sides extending between said ends of said main post;

an elongate arm coupled to one of said sides of said main post, said arm being positioned towards said top end of said main post, said arm having a free end and a length, said length of said arm being extended substantially perpendicular to said length of said main post, said arm being for coupling a mail box thereto;

a wall being provided in said interior space of said main post, said wall dividing said interior space of said main post into upper and lower compartments; said wall being located between said top end of said main post and said arm;

a first light source being provided in said lower compartment of said interior space of said main post, wherein said first light source comprises a fluorescent light bulb;

another side of said main post having a number of lower windows providing openings into said lower compartment of said interior space of said main post, said lower windows permitting light from said first light source to shine therethrough, said lower windows being generally rectangular;

said lower windows being spaced apart from each other, said lower windows being arrange in a row extending between said top and bottom ends of said main post;

each of said lower windows having generally opaque indicia thereon;

a second light source being provided in said upper compartment of said interior space of said main post, said second light source providing light of a unique color, wherein said unique color of said second light source is red;

said main post having a number of upper windows providing openings into said upper compartment of said interior space of said main post, said upper windows permitting passage of light therethrough from said second light source, said upper windows being generally rectangular;

said upper windows being arranged in a row extending around said main post in a plane substantially perpendicular to said length of said main post, wherein each of said sides of said main post has one of upper windows located thereon;

said top end of said main post having a top opening into said upper compartment of said interior space;

a top cap being generally pyramidal covering said top opening of said main post; and first and second remote actuators, said first remote actuator being connected to said first light source, said second remote actuator being connected to said second light source, said first and second remote actuators permitting selective activation of the associated light source.

* * * * *